US005495210A

United States Patent [19]

Forterre et al.

[11] Patent Number: 5,495,210

[45] Date of Patent: Feb. 27, 1996

[54] MINIATURIZED ELECTRONIC DEVICE IN PARTICULAR WITH A GYROMAGNETIC EFFECT

[75] Inventors: Gérard E. E. Forterre, Colombes; Patrick Desmarest, Paris, both of France

[73] Assignee: Tekelec Airtronic, Sevres, France

[21] Appl. No.: 208,734

[22] Filed: Mar. 9, 1994

[30] Foreign Application Priority Data

Mar. 18, 1993 [FR] France ..... 93 03155

[51] Int. Cl.[6] ..... H01P 1/387

[52] U.S. Cl. ..... 333/1.1; 174/266; 361/792

[58] Field of Search ..... 333/1.1; 174/255–258, 174/262, 266; 361/774, 777, 778, 790, 792

[56] References Cited

U.S. PATENT DOCUMENTS

| | | | |
|---|---|---|---|
| 3,102,213 | 8/1963 | Bedson et al. . | |
| 4,821,007 | 4/1989 | Fields et al. | 174/266 X |
| 4,918,409 | 4/1990 | Lamberty | 333/1.1 |
| 5,059,450 | 10/1991 | Mellul et al. | 427/96 |
| 5,159,294 | 10/1992 | Ishikawa et al. | 333/1.1 |
| 5,164,687 | 11/1992 | Kurian et al. | 333/1.1 |
| 5,200,579 | 4/1993 | Takeuchi | 174/266 X |

FOREIGN PATENT DOCUMENTS 2570884 3/1986 France .

*Primary Examiner*—Paul Gensler

*Attorney, Agent, or Firm*—Steinberg, Raskin & Davidson

[57] ABSTRACT

A miniaturized electronic device including a substrate one surface of which carries a first pattern of metallic elements of electrical circuits and a second pattern of metallic elements of electrical circuits which are crossing each other at at least some spots, the crossing elements of electrical circuits being separated by a dielectric material, wherein the device exhibits a multilayer structure, the dielectric material is a serigraphiable dielectric arranged as a thick layer in which the patterns of electric circuits are arranged in different planes, the device being usable for providing reliable devices such as circulation isolators.

20 Claims, 4 Drawing Sheets

Fig. 5
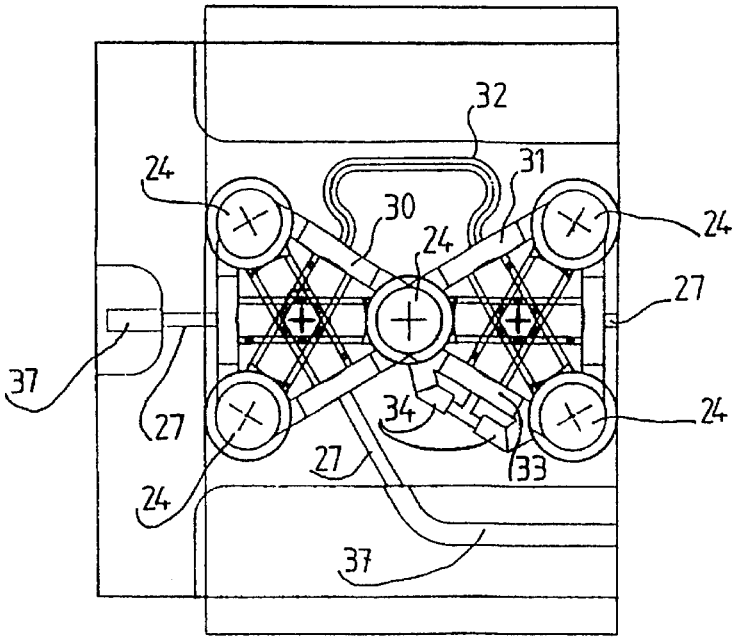
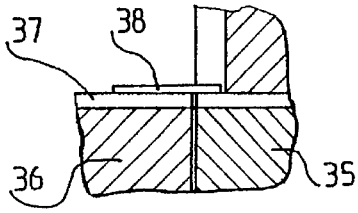
Fig. 6c
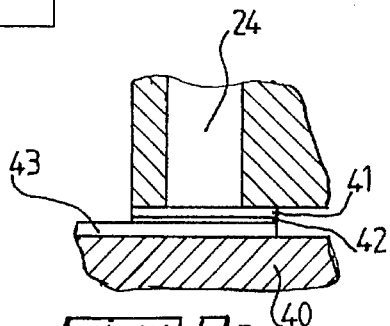
Fig. 7c
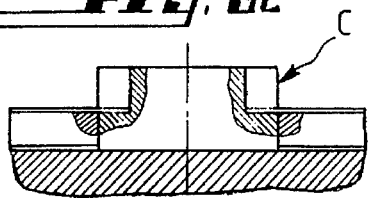
Fig. 6b
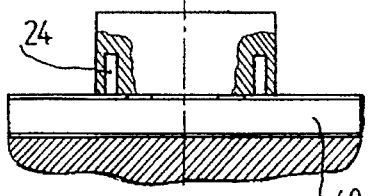
Fig. 7b
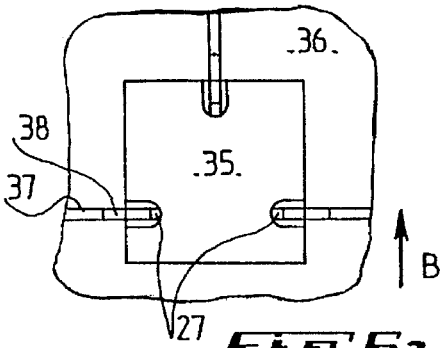
Fig. 6a
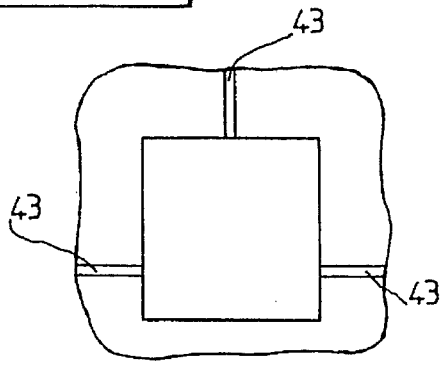
Fig. 7a

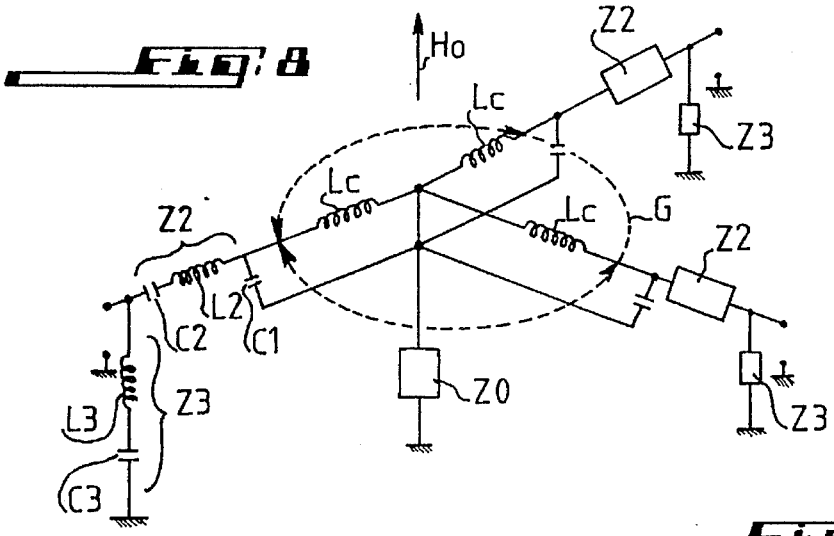
Fig. 8
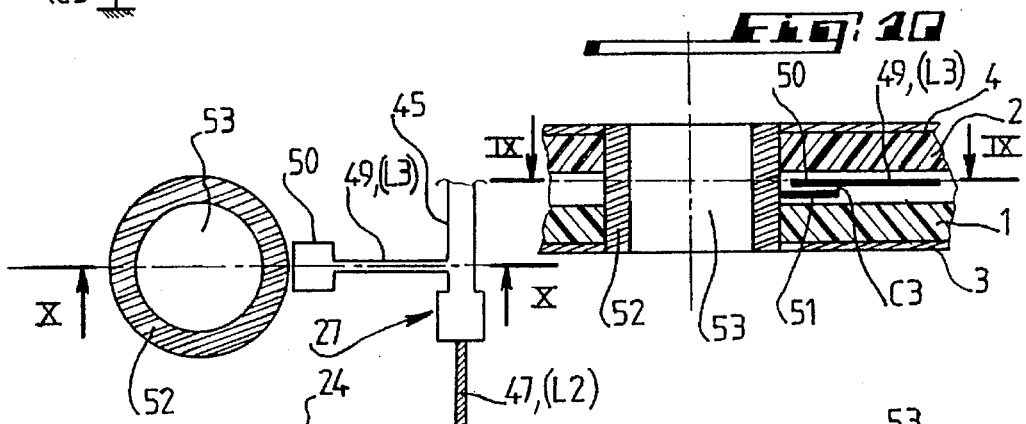
Fig. 10
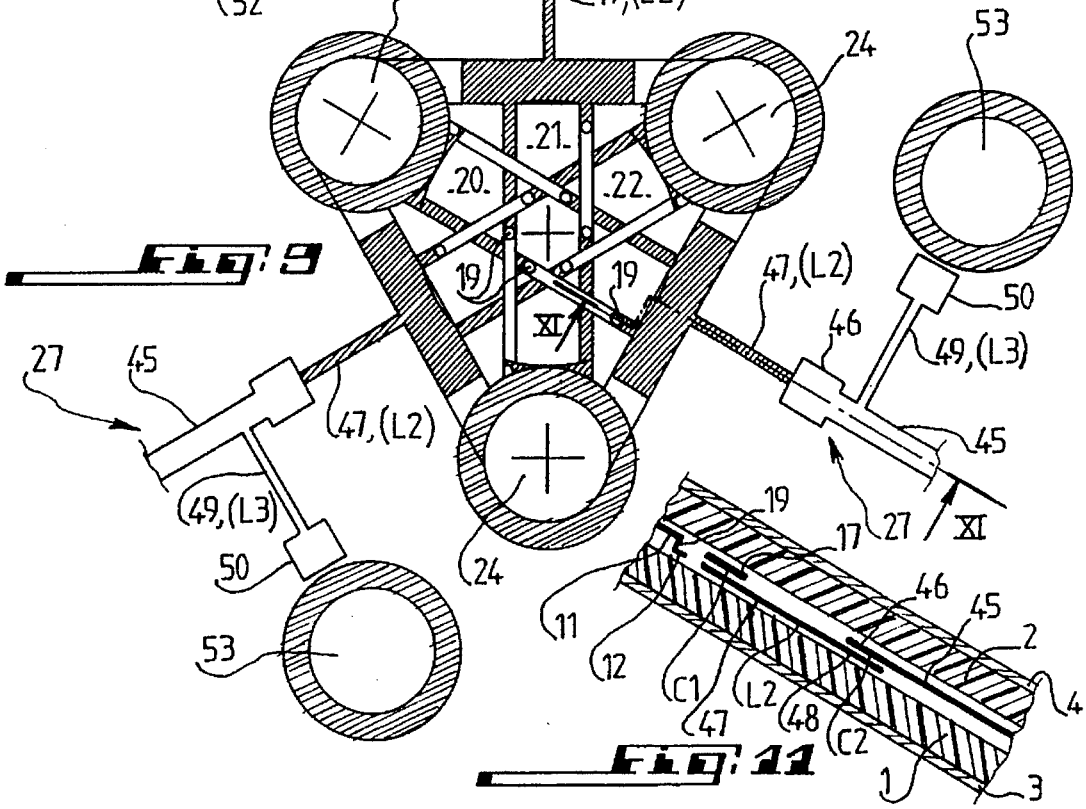
Fig. 9
Fig. 11

MINIATURIZED ELECTRONIC DEVICE IN PARTICULAR WITH A GYROMAGNETIC EFFECT

BACKGROUND OF THE INVENTION

The invention relates generally to a miniaturized electronic device, of the type comprising a substrate one surface of which carries by a first pattern of metallic elements of an electrical circuit and a second pattern of metallic elements of an electrical circuit which are crossing each other at least at some places, the crossing electrical circuit elements being separated by a dielectric material.

As in other fields of electronic devices, one also seeks to reduce the sizes of the devices of the kind which has just been mentioned with the purpose of obtaining ultra-miniature structures which may work at frequencies higher than 3 GHz. One in particular endeavours to provide devices with a gyromagnetic effect: such as circulators or isolators which comprise three inductances angularly offset by 120° on the substrate, these inductances forming the aforesaid patterns of electrical circuits. It is advantageous that in such devices the inductances lie between a lower substrate and an upper substrate the outer surfaces of which are metallized or sprayed with a metal.

In particular two major problems are opposing an ultra-miniaturization, namely the problem of the electrical earthing connection of both metallic layers and the configuration of the inductances and the one raised by the parasitic capacitances resulting therefrom.

As to the problem of these inductances, two solutions have been proposed which however have proved to be insufficient. Thus the inductances or in a more general manner the patterns of electric circuits have been provided in a same plane by providing conducting bridges at the crossing spots of the electrical conductors. This structure did not lead to the ultraminiaturization sought of the device. Another solution consists in providing the patterns of electrical circuits in two different planes electrically insulated by an interposed dielectric and to provide within the dielectric holes permitting suitable circuits elements to be connected. This approach came up heretofore against the impossibility to provide holes with small diameters and with the required accuracy for carrying out the miniaturization. This technological problem is all the more awkward as the thickness of the dielectric increases, which would however be advantageous in some cases of application for example to reduce the spurious capacitances and to increase the operating frequency.

OBJECT AND SUMMARY OF THE INVENTION

The object of the present invention is to provide an electronic device of the type referred to hereinabove, which forms a very satisfactory solution to the problems which have just been set forth.

To reach that goal an electronic device according to the invention is characterized in that it exhibits a multilayer structure, in that the dielectric material is a serigraphiable dielectric and deposited as a thick layer in which the patterns of electric circuits are arranged in different planes.

According to an advantageous characterizing feature of the invention in the case of a device with a gyromagnetic effect such as a circulator, isolator or filter comprising a lower substrate and an upper substrate between which is provided the pattern of the electric circuits and at least one dielectric layer and which are metallized over their outer surfaces, the holes electrically connect both metallization layers and form earth returns or ground connections.

According to another advantageous characterizing feature of the invention the serigraphiable dielectric is a seri-engravable dielectric when the device has to operate at very high frequencies.

BRIEF DESCRIPTION OF THE DRAWINGS

The invention will be better understood and further objects, characterizing features, details and advantages thereof will appears more clearly as the following explanatory description proceeds with reference to the accompanying diagrammatic drawings given by way of non-limiting example only illustrating a presently preferred specific embodiment of the invention and in which:

FIG. 5 diagrammatically shows the structure of a circulator with four gates; and FIGS. 6*a, b, c* and 7*a, b, c* show two modes of connection of a circulator according to the invention onto a supporting substrate, the figure a each time being a bottom view, the figure b being a side view in the direction of the arrow B of figure a and with parts partially broken away, figure c being a view on a largest scale of the detail C of figure b;

FIG. 8 shows an equivalent electrical connection diagram of a circulator with localized parameters;

FIG. 9 is a view in section at the level of the plane shown by the line IX—IX of FIG. 10, comprising the upper circuit pattern with parts partially broken away but shows in attached form portions of the lower circuit pattern, the dielectric being not particularly shown in order to not complicate the understanding of the figure;

FIG. 10 is a view in section taken along the line X—X of FIG. 9 with parts broken away, through the multilayer structure of the circulator; and FIG. 11 is a view in section taken along the line XI—XI with parts broken away of FIG. 9 through the multilayer structure of the circulator.

DETAILED DESCRIPTION OF THE INVENTION

Figure 1:
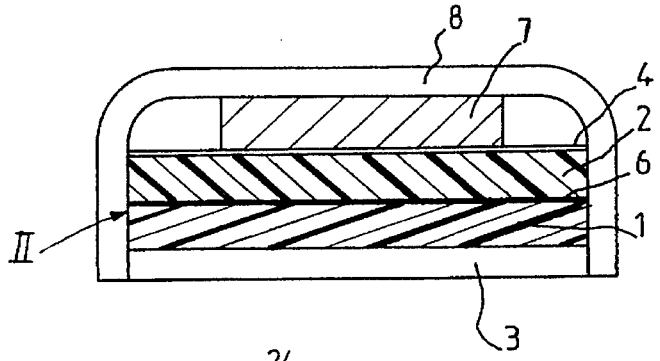
FIG. 1 is a diagrammatic sectional side view of an ultra-miniature circulator according to the present invention.

The invention will be described hereinafter by way of example in its application to a device with a gyromagnetic effect such as a circulator. As shown in FIG. 1 such a device essentially comprises in a preferred embodiment of the invention a lower substrate 1 and an upper substrate 2 made from ferrite which are provided as plates of substantially rectangular shape and the external surfaces of which are metallized by depositing metallic layers 3 and 4, a layer 6 made from a dielectric material which is sandwiched between both substrates 1 and 2, a permanent magnet 7 which is laid or set onto the metallized top surface of the upper substrate 4 as well as a metallic yoke 8 which encloses the whole assembly or unit formed of the stack of both substrates, of the dielectric layer and of the magnet in the fashion of a casing or box and the bottom edge of which is connected to the metallic layer 3 of the lower substrate which is provided so as to form the sole piece or sill of the device.

Figure 2:
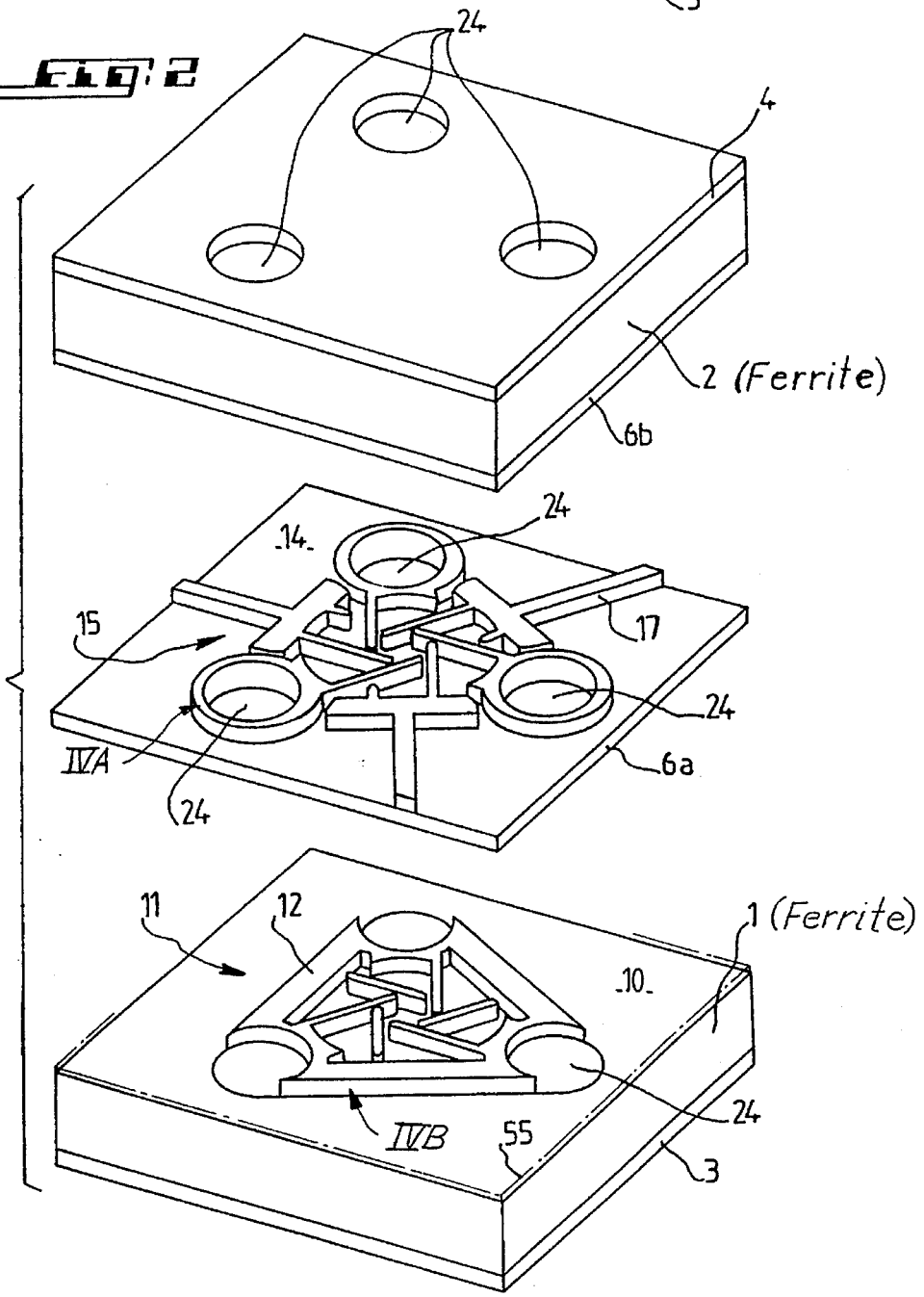
FIG. 2 is an exploded perspective view on a larger scale of that portion of the circulator of FIG. 1 which is shown at II on this figure.
Figure 3:
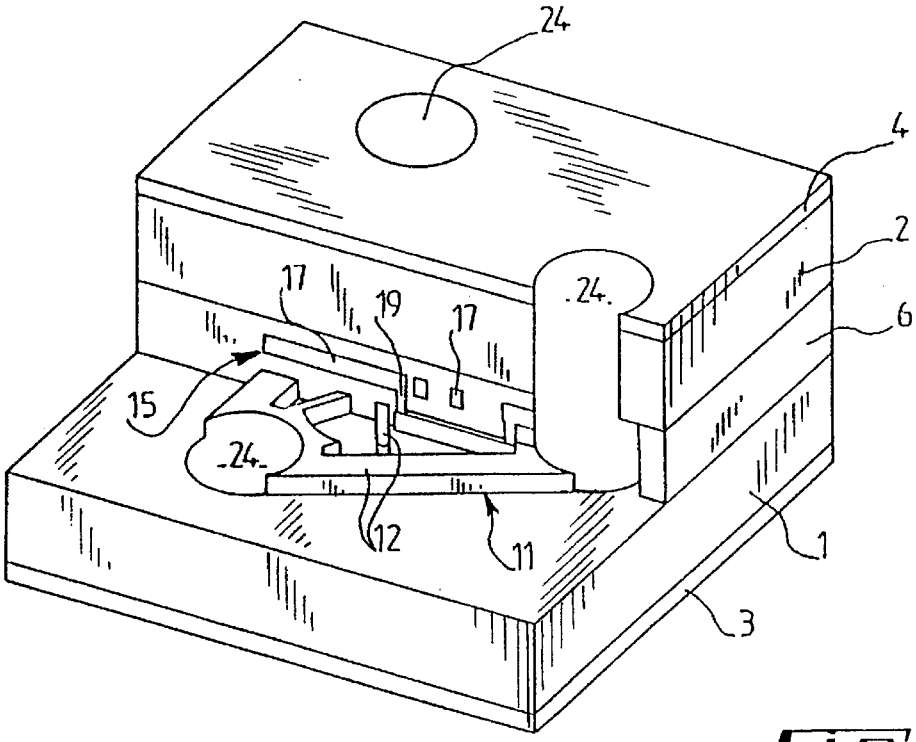
FIG. 3 is a partial sectional view and shows the parts of FIG. 2 in the assembled state.

Referring to FIGS. 2 and 3, it is seen that the inner surface 10 of the lower substrate 1 carries a first pattern 11 of electrical circuit elements formed of metallic strips or pads shown at 12. The height of these pads or strips is exaggerated in the figure to facilitate the understanding of the invention. In FIG. 2 the dielectric layer 6 is shown as consisting of two elementary layers **6*a* and 6*b*. The layer 6*a* which is laid down or set onto the surface 10 of the lower substrate 1 and onto the pattern of electric circuits 11 carries on its top surface 14 a second pattern of elements of electrical circuits 15 also formed of metallic strips or pads shown at 17 the height of which is exaggerated in the figure. The second elementary dielectric layer 6*b* is intended to cover this pattern of electrical circuits 15 while adhering to the bottom surface of the upper substrate 2. In the showing of the actual configuration according to FIG. 3 it is seen that the second pattern of electrical circuits 15 is embedded into the dielectric layer 6**.

Figure 4:
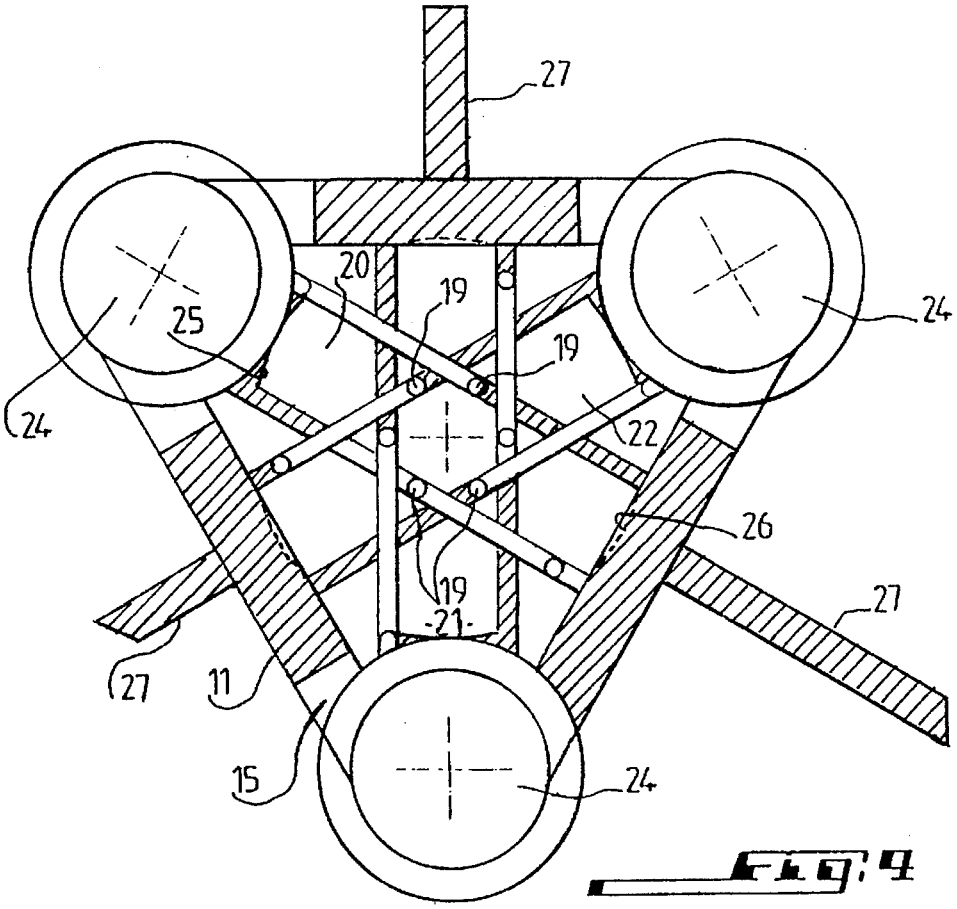
FIG. 4 is a diagrammatic view on a larger scale of the patterns of elements of electrical circuits which form the inductances of the circulator shown at IV A and B on FIG. 2.

Both patterns of electric circuits 11 and 15 individually form one half of the whole device of the three inductances known per se of the circulator which are angularly offset with respect to each other by an angle of 120°. Both halves 11 and 15 of the device of the inductances are electrically connected by electrical connections shown at 19 in FIG. 3 which extend through the dielectric layer at right angles to the plane of laying of the patterns of circuits. FIG. 4 shows on a larger scale the configuration of the three inductances which are bearing the reference numerals 20 to 22. On this figure those elements of the inductances which form a part of the lower circuit pattern 11 are hatched. Those elements which form a part of the upper pattern 15 have been left as blanks. It is seen that in the central part both patterns 15 and 11 are electrically interconnected by six connections 19.

One may furthers recognize on the figures that the metallic layers 3 and 4 are electrically connected to one another by three electrical connections 24 which are extending at right angles through both substrates 1 and 2 and the dielectric layer 6. These connections 24 are arranged according to a triangular configuration. Each inductance is electrically connected with one end at 25 to the connections 24, the other end 26 being connected to access lines of external connections 27 of the circulator.

The structure which has just been described could be provided in an ultra-miniaturized shape with dimensions for example of the order of magnitude of one millimeter owing to the use of a particular dielectric material 6, namely a new seri-engravable, i.e. serigraphiable dielectric ink which is then engravable through a chemical process after insulation, for example such as the one marketed by the firm JOHNSON-MATTHEY Electronic Materials, Orchard Road, Royston, Hertfordshire SG8 R11E, England under the name of JM TC 110. The dielectric formed of this ink exhibits a relative permittivity of 3.9 to 4.2 (based on silica grains) and a loss tangent of $5.10^{-5}$ to 1 GHz and $1.10^{-3}$ to 10 GHz. This dielectric paste permits to make layers with a thickness equal to or greater than 7 μm. Thus a dielectric layer 6 may be made as a thick layer thereby allowing to reduce the spurious capacitance caused by the patterns of electric circuits of the inductances and to thus increase the natural frequency of the gyrator device formed of the whole assembly or unit of substrates and of the dielectric.

This seri-engravable dielectric ink allows the provision of metallized holes of small diameters and with a great accuracy through the dielectric layer 6. The metallization of the holes is effected by seri-engraving. One may provide precise metallized holes for example with a diameter of 50 μm. There is advantageously used as an electrically conducting material a golden ink which provides for a good wetting of the walls of the holes with these small sizes. The holes 24 with a diameter of the order of 300 to 600 μm are advantageously made with a laser.

This dielectric layer made from a seri-engravable material of a good mechanical quality, i.e. providing a good flatness of the surfaces and of a good quality with respect to hyperfrequencies from the standpoint of the angle of loss has permitted not only to reduce in a maximum manner the dimensions of the circulator but also to achieve a direct sealing of both ferrite plates thereby leading to a circulator without any air sheet or gap. Since the dielectric is laid down or set as a layer, the capacitances for the adjustment of the frequency normally made as discrete external capacitors may be provided inside of the circulator by making use of the dielectric of the layer 6 as a dielectric of these capacitors. The suppression of the external capacitors thus contributes considerably to the reduction of the dimensions of the circulator.

Still owing to the seri-engravable dielectric 6 used as a means of direct sealing of the ferrite plate, the miniaturized structure of the circulator exhibits the symmetry which appears from the figures. The absence of air in the structure of the circulator further exhibits the considerable advantage that the magnetic circuit comprises a non magnetic residual minimum air gap only, so that the circulator may comprise one single more easily screenable or shroudable polarization magnet only, as shown in FIG. 1.

FIG. 5 illustrates the technology of a circulator-isolator with four gates which consists of two circulators according to FIGS. 2 to 4 which have one common earth return or ground connection metallized hole and which may thus be arranged within the box or casing 8 so as to be close enough to each other to be able to operate with the same magnetic polarization field produced by a single magnet 7. In this circulator with four tracks or paths, three outlets are connected to the external access tracks 27, two outlets shown at 30 and 31 are connected by an internal connection 32. It is thus seen that a circulator with four tracks such as shown in FIG. 5 merely consists of the judicious association of two circulators with three tracks, the whole being enclosed within a same box or casing of small size.

The invention also permits to convert a circulator with three tracks or four tracks into an isolator by ending one of the gates with the characteristic impedance of the access line.

By ending the remaining outlet 33 with a load adapted to or matching the characteristic impedance of the line, the circulator becomes an isolator. The load is arranged between the access gate 33 and the earth or ground formed of the ground holes 24. The load may consist of two loads with a double impedance connected in series to each one of the metallized holes 24 framing the access gate involved as shown at 34 in FIG. 5. According to the thick layer technology, the load may be directly provided by a suitably sized layer of absorbing ink.

FIGS. 6 and 7 illustrate two modes of connection of a circulator to external access lines 37. In the case of FIG. 6, the connection is made through a thermocompressed ribbon or tape or adhesive whereas the mode of connection according to FIG. 7 is made through connection by surface transfer.

More specifically in the case of FIG. 6, the circulator shown at 35 is placed within an aperture formed in a substrate 36 and the access pads 27 of the circulator are connected to the external access lines 37 by a strip or tape 38 connected to the pad 27 and to the access line 37 through thermocompression or adhesive bonding. In the case of FIG. 7 the circulator is laid down upon the supporting substrate shown at 40 so that the metallized holes 24 the end of which is surrounded and closed by a metallic disk, i.e. a golden disk 41, by adhesive bonding or hard-soldering or brazing shown at 42 to one access line shown at 43.

Referring to FIGS. 8 to 11, an embodiment of a circulator which illustrates some advantages of the principle of carrying out the invention which has just been described herein before will be described hereinafter more in detail.

FIG. 8 shows the equivalent electric connection diagram of such a circulator with localized elements. The circled portion constitutes the gyromagnetic system G comprising the three above-mentioned inductances shown at Lc. With this gyromagnetic device is associated the capacitance C1 which constitutes the above-mentioned tuning capacitance as being integratable into the dielectric layer 6 and an earthed or ground connected impedance ZO. For each access track is moreover provided a series band widening system Z2 and a parallel band widening system Z3. The system mounting in series within the access track comprises a capacitance C2 and an inductance L2 whereas the parallel system is formed of the capacitances C3 and one inductance L3.

FIGS. 9 to 11 show the concrete design of the tuning capacitors C1 and of the broadening systems or networks Z2 and Z3 as elements integrated into the multilayer structure of the circulator. In these figures the circuit elements of FIG. 8 are bearing the same reference numerals to facilitate their identification. It is thus seen that the line 27 of access to the gyromagnetic device G comprises a first access track portion 45 provided in the plane of the top pattern 15 and terminating into a widening 46 and a second portion of access line 47 which lies in the plane of the bottom pattern 11, exhibits a smaller width than the portion 45 and is connected to the corresponding gate of the bottom pattern 11. This portion forms the inductance L2 whereas the broadening 46 of the portion of access track 45 and the end portion of the portion 47 located underneath the widening 46 is separated from the latter by some dielectric of the layer 11 forms the capacitor C2. The sectional view of FIG. 11 illustrates well what has just been said. At the left of this sectional view is moreover seen the connection through a metallized hole 19 of an element 12 of the lower pattern 11 to an element 17 of the upper circuit pattern 15.

The system of widening the strip Z3 comprises according to FIGS. 9 and 10 a portion of conductive track 49 deposited in the plane of the top pattern 15. This track portion is connected with one end to the access track portion 45 and terminates at the free end into a widening 50. Below the broadening 50 in the plane of the bottom pattern 11 is provided a pattern element 51 which is connected to the metallic layer 52 covering the walls of a metallized hole 53 which electrically interconnects the top and bottom metallic layers 3 and 4 of the multilayer structure of the circulator in the same manner as the metallized holes 24. The elements 50, 51 form the capacitance C3 whereas the line portion 49 of smaller width forms the inductance L3.

As to the impedance ZO, it may be provided on one of the external faces of the sandwich according to a structure similar to that of the impedance Z2 described hereinabove.

FIGS. 9 to 11 clearly illustrate the advantage of the multilayer structure provided by the invention and making use of a dielectric which may be made as a thick layer 6 permitting to embed into that layer patterns of electric circuits arranged at different levels and to form inside of the dielectric layer circuit elements which in the state of the art are formed of separate components.

In the structure which has just been described with reference to the figures, the bottom circuit pattern 11 is directly deposited upon the lower substrate made from metallized ferrite 1. To improve the flatness of the layer supporting this electric pattern, it could be possible to at first provide upon the substrate a layer of dielectric as a varnish and then to deposit the electric pattern onto this dielectric layer also advantageously provided as a serigraphiable thick layer. This layer shown in chain-dotted lines in FIG. 2 improves the manufacturing output and the power behaviour of the circulator.

In the foregoing has been described a circulator particularly adapted to operate in the band of 10 GHz owing to the use of a seri-engravable dielectric paste. Such a dielectric is necessary when the circulator has to operate at very high frequencies up to 10 GHz. But in a somewhat lower frequency range, for example in the band of 4 or 5 GHz, it is sufficient to use a serigraphiable dielectric without bringing structural modifications except for an adaptation of dimensions. For carrying out the invention it is indeed essential that the dielectric be a dielectric capable of being applied as a thick layer. Now a serigraphiable dielectric perfectly meets this requirement. It is also desirable that the dielectric be made from a material with a small loss which is a requirement that a serigraphiable dielectric available on the market may also comply with. It is only when it is desired to obtain a device which may operate at higher frequencies that it is necessary to use a serigraphiable dielectric which also is engravable as in the example which has just been described with reference to the figures.

Many modifications may of course be brought to the device which has just been described. Thus could be contemplated a gyrator structure which could comprise a lower substrate made from metallized alumina and an upper substrate made from metallized ferrite or also a lower substrate made from metallized ferrite and a magnet carrier or holder made from alumina or from any other dielectric, whereas the metallized holes could then be formed in the ferrite only.

The invention such as it has been described with reference to the figures exhibits many major advantages with respect to the state of the art. It allows to obtain an ultra-miniaturized device adapted to operate at very high hyperfrequencies. It is thus possible to provide circulators in the band of 10 GHz in particular owing to the use of the seri-engravable dielectric paste applicable as a thick coat permitting to provide through seri-engraving the electrical interconnections as metallized holes. Since the dielectric layer also serves as a means for sealing both substrates in particular made from ferrite, there is obtained a multilayer symmetrical structure without any air interstice and very reliable once the firing operations have been completed and requiring one single polarization magnet only. The "all ceramic monobloc" structure is sintered at high temperature. It is therefore directly weldable by the side of chips of integrated circuit of the GaAs or silicon type. The use of a dielectric applicable as a thick layer further permits to integrate into the multilayer structure the tuning capacitances which in the case of the devices made according to the technology of the state of the art are discrete components.

In summary the invention allows to obtain electric energy transmission devices with a gyromagnetic effect such as circulators, isolators or filters which are ultra-miniaturized, may work at frequencies up to 10 GHz while being capable of being manufactured at low cost and according to a collective technology.

What is claimed is:

1. A miniaturized electronic device having a multilayer structure, comprising a substrate, a layer of dielectric material superimposed on said substrate, said dielectric material layer being a serigraphiable dielectric material layer deposited as a thick layer on said substrate, a first and second pattern of metallic electrically conducting circuit elements supported by and arranged in different planes within said dielectric thick layer, said first and second circuit element patterns being located distant from one another in the direction of superposition of said multilayer structure, and means for electrically connecting said first and second circuit patterns via throughholes traversing said dielectric thick layer, said throughholes being seri-engraved as small metallized holes.

2. An electronic device according to claim 1, further comprising tuning capacitances for tuning the frequency of the device, said tuning capacitances being integrated into the dielectric layer.

3. An electronic device according to claim 1, wherein said serigraphiable dielectric is a seri-engravable dielectric such that the electronic device works at high frequencies up to about 10 GHZ.

4. An electronic device with a gyromagnetic effect, such as a circulator or isolator, having a multilayer structure, comprising a lower substrate and an upper substrate situated in a superimposed arrangement, at least one of said lower substrate and said upper substrate being made from ferrite, a layer of dielectric material situated between said lower and upper substrates, said dielectric layer being a serigraphiable dielectric material layer deposited as a thick layer between said lower and upper substrates, first and second patterns of metallic electrically conducting circuit elements supported by said dielectric thick layer and arranged in different planes within said dielectric thick layer distant from one another in the direction of the superposition of said arrangement, means for electrically connecting said first and second circuit patterns via throughholes traversing said dielectric material layer, said throughholes being seri-engraved as very small diameter metallized holes, and means for metallizing a respective surface of each of said upper and lower substrates which are opposite to surfaces between which said dielectric thick layer is placed, said metallizing means comprising holes for interconnecting the respective metal surface of said lower and upper substrates through said substrates and said dielectric thick layer.

5. A device according to claim 4, wherein the dielectric layer forms the means for sealing the lower and upper substrates.

6. An electronic device according to claim 4, further comprising tuning capacitances integrated into said dielectric thick layer for tuning the frequency of the device.

7. An electronic device according to claim 4, having gyromagnetic device polarization magnet means included in a magnetic circuit, and arranged in a metallic casing in contact with a metallized surface of one of said substrates, said magnet means comprising a single polarization magnet located between said casing and a metallized surface of the other of said substrates, said metallic casing forming a yoke for said magnetic circuit.

8. An electronic device according to claim 4, wherein said upper and lower substrates are ferrites.

9. An electronic device with a gyromagnetic effect, such as a three gate circulator each gate of which is connected to an access line of an external connection, and having a multilayer structure, comprising a lower substrate and an upper substrate situated in a superimposed arrangement, at least one of said lower substrate and said upper substrate being made from ferrite, a layer of dielectric material arranged between said lower and upper substrates, said dielectric layer being a serigraphiable dielectric material layer deposited as a thick layer between said lower and upper substrates, a first and a second pattern of metallic electrically conducting circuit elements supported by said dielectric material layer, said first and second circuit element patterns being located in different planes within said dielectric thick layer distant from one another in the direction of the superposition of said arrangement, means for electrically connecting said first and second circuit patterns via throughholes traversing said dielectric material layer, said throughholes being seri-engraved as very small diameter metallized holes, and means for metallizing a respective surface of each of said upper and lower substrates which are opposite to surfaces between which said dielectric thick layer is placed, said metallizing means comprising holes for interconnecting the respective metal surface of said lower and upper substrates through said substrates and said dielectric thick layer, said first and the second patterns each constituting one half of an arrangement of three inductances electrically isolated from each other, each of said inductances having two ends, one end being electrically connected to one of said holes of said metallization means and the other end being electrically connected to one of said three gates.

10. A circulator with four gates, comprising two three-gate circulators according to claim 9 juxtaposed by using a common metallized hole as a electrical connection of the grounding planes, further comprising external access tracks for connecting to outlets of said gates of said two three-gate circulators.

11. An electronic device with a gyromagnetic effect, wherein, for forming a circulator with four gates, two three-gate circulators according to claim 9 are juxtaposed in a way that they have one of said interconnecting holes of said metallization means in common, further comprising external access tracks for connecting two outlets of said gates of said two three-gate circulators.

12. An electronic device according to claim 11, wherein said device constitutes an isolator to one gate of which is coupled an impedance equal to the impedance of the access line.

13. An electronic device according to claim 11, having four gates and constituting an isolator, wherein a load is connected between one of said gates and two of said metallized surface interconnecting holes, said load being arranged to match an access line impedance and being formed by serigraphy.

14. An electronic device according to claim 13, wherein said load is constituted by two loads each arranged between one of said gates and one of said interconnecting holes.

15. An electronic device according to claim 9, further comprising band broadening impedances including inductance means and capacitance means integrated in said multilayer structure, said inductance means comprising one portion of one of said conducting circuit elements and said capacitance means comprising a portion from each of said first and second conducting circuit elements.

16. An electronic device according to claim 15, wherein each of said gates is connected to an access line by an access track formed by one portion of one of said conducting circuit elements and comprises two track portions, one in each of said first and second conducting circuit elements, having ends adjacent to and spaced from one another, one of said track portions constituting said inductance means and the adjacent ends of said two track portions constituting said capacitance means.

17. An electronic device according to claim 16, wherein one of said band broadening impedances is mounted in parallel to said access track between said access track and a reference potential and comprises an electrically conducting element with a width appropriate to form said inductance means, said electrically conducting element being arranged in one of the planes of said first and second conducting circuit elements and being connected at a first end to said access track portion and, at an opposite, second end, being arranged above a conducting element arranged in the other of the planes of said first and second conducting circuit elements and being connected to a metallized hole for interconnecting the substrate surface metallizing means, the second end and said conducting element constituting said capacitance means.

18. An electronic device according to claim 9, adapted to be assembled to a separate substrate provided with a cavity for locating therein said electronic device, and with an external connection access line for each of a plurality of electronic device access lines, wherein each of said external connection access lines is connected to its associated electronic device access line by an electrically conducting strip portion secured to said external connection access line and said electronic device access line.

19. An electronic device according to claim 9, adapted to be assembled to a separate substrate provided with an external connection access line for each of a plurality of electronic device access line, wherein said electronic device is mounted on said separate substrate and the external access lines and a respective one of said electronic device access lines to be connected to one another are secured to one another by bonding.

20. An electronic device according to claim 9, having three gates and constituting an isolator, wherein a load is connected between one of said gates at one of said metal surface interconnecting holes, said load being arranged to match an access line impedance and formed by serigraphy.

* * * * *